US012049754B2

(12) United States Patent
Binder

(10) Patent No.: US 12,049,754 B2
(45) Date of Patent: Jul. 30, 2024

(54) ROOM MODULES FOR BUILDINGS

(71) Applicant: BINDER BETEILIGUNGS AG, Fugen (AT)

(72) Inventor: Matteo Binder, Fugen (AT)

(73) Assignee: BINDER BETEILIGUNGS AG, Fugen (AT)

( * ) Notice: Subject to any disclaimer, the term of this patent is extended or adjusted under 35 U.S.C. 154(b) by 217 days.

(21) Appl. No.: 17/635,018

(22) PCT Filed: Dec. 1, 2020

(86) PCT No.: PCT/EP2020/084098
§ 371 (c)(1),
(2) Date: Feb. 14, 2022

(87) PCT Pub. No.: WO2021/110669
PCT Pub. Date: Jun. 10, 2021

(65) Prior Publication Data

US 2022/0290423 A1 Sep. 15, 2022

(30) Foreign Application Priority Data

Dec. 2, 2019 (DE) ..... 10 2019 132 612.5

(51) Int. Cl.
*E04B 1/348* (2006.01)

(52) U.S. Cl.
CPC ..... *E04B 1/34869* (2013.01)

(58) Field of Classification Search
CPC ..... E04B 1/34869; E04B 1/34807
See application file for complete search history.

(56) References Cited

U.S. PATENT DOCUMENTS 2,037,895 A * 4/1936 Gugler ..... E04B 1/34869 52/36.2
3,694,973 A * 10/1972 Unger ..... E04C 2/521 52/125.4

(Continued)

FOREIGN PATENT DOCUMENTS

CH 277579 A 9/1951
DE 29607534 U1 7/1996

(Continued)

OTHER PUBLICATIONS

International Search Report and Written Opinion (with English translation of International Search Report) issued in corresponding International Patent Application No. PCT/EP2020/084098 dated Feb. 24, 2021 (10 pages).

(Continued)

*Primary Examiner* — Theodore V Adamos
(74) *Attorney, Agent, or Firm* — Kilyk & Bowersox, P.L.L.C.

(57) ABSTRACT

The invention relates to a room cell for use in the modular construction of buildings, which comprises a base plate and side walls enclosing a usable interior space, wherein the load-bearing components of some and preferably all side walls are formed by panels of cross-laminated timber, wherein the room cell comprises a duct for accommodating cables and pipes passing through the room cell from top to bottom, wherein the duct is confined on its bottom by a duct floor or on its top by a duct ceiling, and wherein the duct floor or the duct ceiling comprise a step projecting upwards or downwards, respectively, into the duct.

18 Claims, 2 Drawing Sheets

(56) References Cited

U.S. PATENT DOCUMENTS

Figure 1:
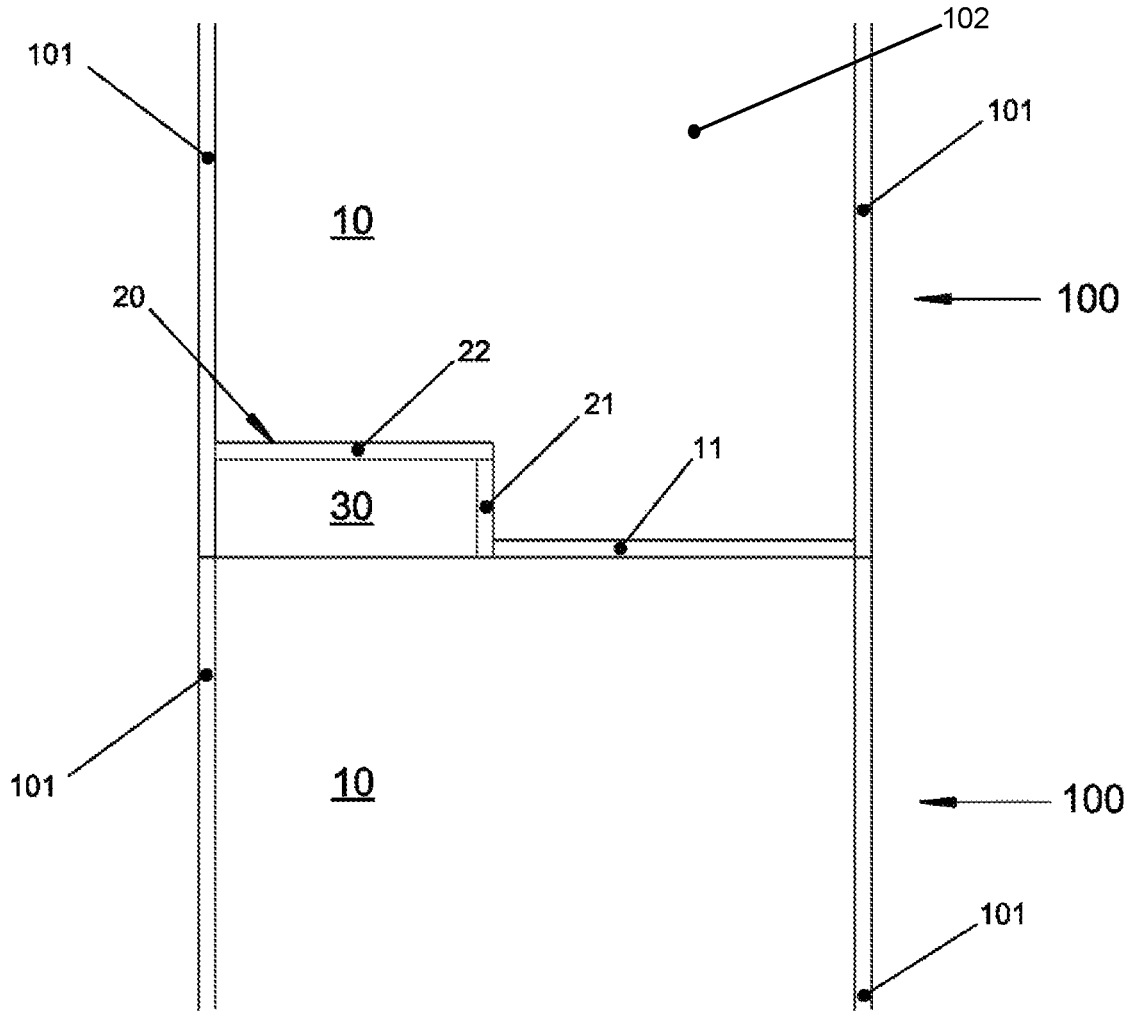

| | | | | |
|---|---|---|---|---|
| 2011/0296778 | A1* | 12/2011 | Collins | E04C 2/521 52/745.1 |
| 2014/0013678 | A1* | 1/2014 | Deverini | E04B 1/34807 52/79.1 |
| 2017/0002579 | A1* | 1/2017 | French | E04B 1/34807 |
| 2019/0136509 | A1* | 5/2019 | Binder | E04B 1/34861 |

FOREIGN PATENT DOCUMENTS

| | | | | | |
|---|---|---|---|---|---|
| EP | 3480380 | A1 | | 5/2019 | |
| GB | 2547514 | A | * | 8/2017 | A47K 4/00 |
| WO | WO-2009005449 | A1 | * | 1/2009 | E04B 1/04 |

OTHER PUBLICATIONS

Search Report issued in corresponding German Patent Application No. 10 2019 132 612.5 dated May 14, 2020 (7 pages).

International Preliminary Report on Patentability issued in corresponding International Patent Application No. PCT/EP2020/084098 mailed May 3, 2021 (with English translation mailed Jun. 2, 2022) (11 pages).

* cited by examiner

ROOM MODULES FOR BUILDINGS

This application is a National Stage Application of PCT/EP2020/084098, filed Dec. 1, 2020, which claims priority to German Patent Application No. 10 2019 132 612.5, filed Dec. 2, 2019.

The present invention relates to a room cell for use in the modular construction of multilevel buildings.

It is known from the state of the art to use room cells in the construction of modular multilevel buildings, the room cells comprising wet cells and installations and further comprising vertical ducts for leading cables and pipes to above and below levels of the building.

The construction of said ducts poses a specific challenge. They should be constructed such that the connection of superimposed room cells during the building construction is as easy as possible. In the completed building the ducts should be easily accessible and maintenance friendly. Additionally, high standards of noise and fire insulation have to be met.

EP 3 480 380 A1 contemplates a concept of two separate ducts for installation pipes on the one hand and electrical cables and data cables on the other hand. This concept enables an easy connection of superimposed room pods and is also maintenance friendly. Proper noise and fire insulation of the vertical duct walls allows to meet the legal requirements in most countries.

The problem underlying the invention is the provision of an improved duct concept for room cells of the generic kind, which even better meet said standards, with particular emphasis on fire insulation.

Against this background the invention relates to a room cell for use in the modular construction of buildings, which comprises a base plate and side walls enclosing a usable interior space, wherein the load-bearing components of some and preferably all side walls are formed by panels of cross-laminated timber, and wherein the room cell comprises a duct for accommodating cables and pipes passing through the room cell from top to bottom. According to the invention, the duct is confined on its bottom by a duct floor or on its top by a duct ceiling, wherein the duct floor or the duct ceiling comprise a step projecting upwards or downwards, respectively, into the duct.

Starting from the level of the duct floor or the duct ceiling, the step projects upwards or downwards, respectively, into the duct. The step preferably rises from the duct floor or lowers from the duct ceiling at one side of the duct, respectively, with the typically horizontal plateau of the step ending at a peripheral wall of the duct. Next to the typically horizontal plateau the step comprises one or more typically vertical ramps, which together with the plateau define the step. A free volume is defined in the recess that is carved out from the duct by the step.

The inventive design of the duct enables a horizontal decoupling of ducts of stacked room cells with regard to noise and fire. The horizontal decoupling is effected by the duct floor and the ramps and plateaus of the step. Nevertheless, a free volume in which cables and pipes of adjacent room cells can easily be connected remains after they have been stacked.

Cross-laminated timber is a very stiff and stable material. It is well suited for load-bearing purposes in the building industry. Wood is environmentally friendly and renewable. It is comparatively cheap, durable and in high demand. In one embodiment, the side walls of the room cell are made entirely from cross-laminated timber plates, which can be at least partially coated or clad on one or both surfaces.

The duct preferably passes through the room cell from top to bottom. It is preferably defined between a side wall of the room cell and a duct wall inside the room cell, which separates a usable space of the room cell from the duct. The duct can be separated into different sections by vertical partitions or can be one single duct.

The duct preferably is confined on its bottom by a duct floor, wherein the duct floor comprises a step projecting upwards into the duct.

The duct preferably has an open top or an open bottom, respectively.

Further preferably the duct floor and the base plate are at the same level. In this regard, reference is made to the duct floor apart from the step. The step projects upwards starting from that level.

In a further preferred embodiment the room cell has load-bearing properties and is able to withstand a vertical load corresponding to more than double of its own weight, preferably more than five times its own weight and more preferably more than eight times its own weight. The load-bearing properties are attributable to the cross-laminated timber plates of the side walls. In contrast to a self-supporting wall, which only bears its own weight and cannot be loaded statically by other building components, the load-bearing walls can be loaded statically by other parts of the building, for example a further room cell placed on top of the room cell.

The duct typically accommodates a plurality of standpipes and/or cable pipes for housing cables, wherein the standpipes and/or cable pipes pass through the duct in the region of the steps and openings. The standpipes can serve as water pipes or ventilation pipes when installed. The cable pipes can enclose electrical cables and data cables.

In this context it may be provided that the standpipes and/or cable pipes penetrate to the outside through the step and comprise connection elements for connection to standpipes and/or cable pipes of an adjacent room cell in the recess defined by the step. The step located in the lower part of the duct is preferably penetrated in a downward direction, while the step projects into the duct from below and forms the recess thereunder. The connection elements are located above the level of the duct floor. More specifically, the typically horizontal plateau of the step is penetrated. The horizontal fire insulation at the points of penetration of the standpipes and/or cable pipes through the step is preferably facilitated through the use of certified fire protection elements such as fire protection collars.

In addition, it may be provided that the ends of the standpipes and/or cable pipes comprise mating connection elements that correspond to the connection elements in the recess, wherein preferably the standpipes and/or cable pipes or their mating connection elements protrude from the duct and extend beyond the height of the room cell, or can be moved between a retracted position, where this is not the case, to an extended position, where this is the case. The mating connection elements are thus preferably located above the room cell.

The connection elements and mating connection elements can be configured to form a reversible connection, preferably to be connected and disconnected without the use of tools. In this connection, it may be that the connection elements and mating connection elements are configured for connecting by snap-fit or screwing. The connection elements and/or mating connection elements can further be configured to be movable between a retracted position and an extended position, for example by folding them out.

In connection with the possible interior elements of the room cell, the possibility of connecting the cables and pipes to electrical elements and installations of the room cell, the detailed structural design of the walls, the connection of the components of the room cell, the connection of standpipes and/or cable pipes of adjacent room cells and the constructive design of the room cell in general, apart from the design of the duct and its constituents herein, reference can generally be made to the disclosure of EP 3 480 380 A1.

Against the initially mentioned background the invention further relates to a building comprising at least two room cells according to the invention stacked directly on top of each other, characterized in that the room cells are stacked such that the ducts of the room cells are in alignment.

When putting up a multilevel building using the room cells, the standpipes of adjacent levels can be connected with preferably flexible connecting tubes or pipes. The connecting elements can be unilaterally attached to the lower ends of the standpipes.

The building is preferably a multilevel building comprising more than two, preferably more than five and further preferably more than eight levels. Due to their load-bearing character, the room cells according to the invention are particularly well suited for use in such so-called mid-high-rise buildings.

Figure 2:
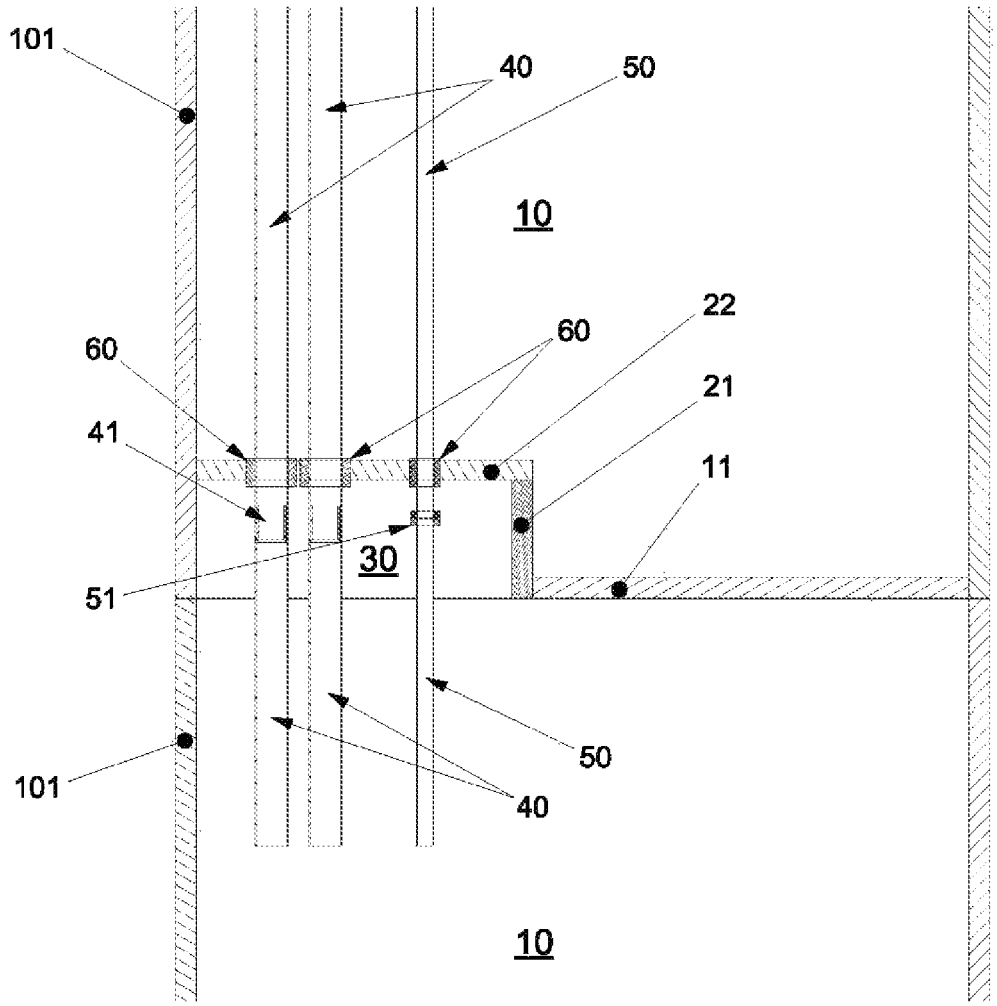

Further details and advantages of the invention become apparent from the working example, which is described in the following with reference to the figures. The figures show:

FIG. 1: a view onto the uncovered ducts of two stacked room cells according to one embodiment of the invention; and FIG. 2: a detailed view on the area around the step, wherein standpipes and cable pipes have been added vis-à-vis the illustration of FIG. 1.

FIG. 1 shows a view onto the uncovered ducts 10 of two stacked room cells 100 according to one embodiment of the invention.

The ducts 10 are located on one side of the room cell 100 and extend over its entire width, i.e. from one side wall 101 to the opposite side wall 101 of the room cell 10. A further side wall limiting the ducts 10 to the back is not shown in the figure so as to not obstruct the view onto the ducts 10. Each of the ducts 10 is hence delimited by three side walls 101 and one duct wall 102.

The supporting components of the side walls 101 are formed by panels of cross-laminated timber. To form the side walls 101, the panels of cross-laminated timber may be coated or clad on one or both sides thereof. Through the use of stable cross-laminated timber elements in the side walls 101, the room cell overall has load-bearing capability and can withstand a vertical load corresponding to at least eight times its own weight. These load-bearing properties make it possible to stack eight or even more than eight room cells in a multi-level building.

FIG. 1 shows the lower area of the duct 10 of the upper room cell 100 and the upper area of the duct 10 of the lower room cell 100. The ducts 10 of both room cells 100 are identical, so that the lower area of the duct 10 of the lower room cell 100 corresponds to the illustrated lower area of the duct 10 of the upper room cell 100 and the upper area of the duct 10 of the upper room cell 100 corresponds to the illustrated upper area of the duct 10 of the lower room cell 100.

The duct wall 102 separates the duct 10 from the usable interior space of the respective room cell. The surfaces of the duct wall 102 and the portions of the side walls 101 enclosing the ducts 10 are fully covered with a fire protection cladding in the form of, for example, gypsum plasterboards, or with a fire protection coating or impregnation.

The duct 10 of the upper room cell 100 is confined on its bottom by a duct floor 11. The duct floor 11 is at level with the base plate of the room cell 100. The ducts 100 pass through the room cells 100 from top to bottom.

The duct floor 11 of the upper room cell 100 comprises a step 20 having a vertical ramp 21 and a horizontal plateau 22. Starting from the level of the duct floor 11 the step 20 projects upwards into the duct 10 of the upper room cell 100. On its, with reference to FIG. 1, left side the step 20 leans against side wall 101 of the room cell 100, such that it comprises only one ramp 21. A free volume 30 with open bottom is defined in the recess that is carved out from the duct 10 by the step 20.

The duct 10 of the lower room cell 100 has an open top and is hence open towards the free volume 30 of the room cell 100 positioned above.

As apparent from the detailed view of FIG. 2, which shows the transition area between the room cells 100 and particularly the area around the step 20, a number of corresponding standpipes 40 and cable pipes for housing cables are accommodated in the ducts 10. These need to be connected after stapling of the room cells 100 to form continuous lines or pipes, respectively, running from one level of the building to the next. The standpipes 40 can be water pipes or ventilation pipes. The cable pipes 50 can encompass electrical cables and data cables.

As shown in FIG. 2, at the lower end of the upper room cell 100 the standpipes 40 and cable pipes 50 penetrate through the horizontal plateau 22 of the step into the free volume 30 and end at a position slightly above the level of the bottom of the room cell 100. Fire protection sleeves 60 are provided at the penetration points of the standpipes 40 and cable pipes 50 through the horizontal plateau 22.

As further shown in FIG. 2, standpipes 40 and cable pipes 50 protrude from the top of the duct 10 of the lower room cell 100 and hence extend beyond the height of the lower room cell 100. They end in the free volume 30 below the step 20 of the upper room cell 100 at exactly the position where also the corresponding standpipes 40 and cable pipes 50 of the upper room cell 100 end.

The corresponding standpipes 40 and cable pipes 50 are connected at their meeting points by mating connection elements 41 and 51, respectively, which may be interlockable sleeves and flange elements.

To facilitate easy access to the duct for possible maintenance work, maintenance openings can be provided in the duct wall 102 or in portions of the side walls 101 enclosing the ducts 10. Preferably, at least one maintenance opening is provided in the wall parts enclosing the free volume 30.

The inventive design of the ducts 10 facilitates horizontal decoupling, with respect to fire and sound propagation, of the ducts 10 of stacked room cells 100 by action the duct floors 11, ramps 21 and plateaus 22 of the steps 20. The free volume 30 of the step, which is open towards the lower room cell 100, forms an idle space in the level newly formed after stacking adjacent room cells 100, where standpipes 40 and cable pipes 50 of stacked room cells 100 can be connected in a simple manner. The free space 30 below step 20 of the upper room cell 100 represents kind of an extension of the duct 10 of the lower room cell 100.

The invention claimed is:

1. A room cell for use in a modular construction of buildings and configured to be stacked upon and support other room cells, the room cell comprises a base plate and side walls enclosing a usable interior space, wherein load-bearing components of at least some side walls are formed by panels of cross-laminated timber, and wherein the room cell comprises a duct that runs from top to bottom of the room cell, wherein, within the duct, the duct is confined at a bottom of the duct by a duct floor or at a top of the duct by a duct ceiling, wherein the duct floor or the duct ceiling is horizontally disposed and extends between a side wall of the room cell and a peripheral wall of the duct, the duct floor or the duct ceiling comprising a step projecting upwards or downwards, respectively, into the duct, the step comprising of an upward segment and a sideward segment, wherein the duct floor or the duct ceiling extends to and terminates at the upward segment so that a free volume that is opened at a bottom or a top, respectively, is defined in a recess that is carved out from the duct by the step, and the duct is for accommodating cables and pipes passing through a region of the step from the top to the bottom of the duct.

2. The room cell according to claim 1, wherein the duct is confined at the bottom of the duct by the duct floor, wherein the duct floor comprises a step projecting upwards into the duct.

3. The room cell according to claim 1, wherein the duct has an open top in case the duct is confined at the bottom by the duct floor or has an open bottom in case the duct is confined at the top by the duct ceiling.

4. The room cell according to claim 1, wherein the duct floor, apart from the step, and the base plate of the room cell are at the same level.

5. The room cell according to claim 1, wherein the room cell has load-bearing properties and is able to withstand a vertical load corresponding to more than double of a weight of the room cell.

6. The room cell according to claim 1, wherein the duct accommodates a plurality of standpipes and/or cable pipes for housing cables, wherein the standpipes and/or cable pipes pass through the duct in the region of the step.

7. The room cell according to claim 6, wherein the standpipes and/or cable pipes penetrate to an outside through the step and comprise connection elements for connection to standpipes and/or cable pipes of an adjacent room cell in the recess carved out from the duct by the step.

8. The room cell according to claim 7, wherein ends of the standpipes and/or cable pipes comprise mating connection elements that correspond to the connection elements within the recess.

9. The room cell according to claim 8, wherein the connection elements and mating connection elements are configured to form a reversible connection.

10. The room cell according to claim 8, wherein the connection elements and mating connection elements are configured to form a reversible connection and are capable of being connected and disconnected without the use of tools.

11. The room cell according to claim 7, wherein ends of the standpipes and/or cable pipes comprise mating connection elements that correspond to the connection elements within the recess, and wherein the standpipes and/or cable pipes or their mating connection elements protrude from the duct and extend beyond the height of the room cell, or can be moved between a retracted position, where this is not the case, to an extended position, where this is the case.

12. A building comprising at least two room cells according to claim 1, and stacked directly on top of each other, wherein the room cells are stacked such that the ducts of the room cells are in alignment.

13. The building of claim 12, wherein the building is a multilevel building comprising more than two levels.

14. The building of claim 12, wherein the building is a multilevel building comprising more than five levels.

15. The building of claim 12, wherein the building is a multilevel building comprising more than eight levels.

16. The room cell of claim 1, wherein said load-bearing components of all of said side walls are formed by said panels of cross-laminated timber.

17. The room cell according to claim 1, wherein the room cell has load-bearing properties and is able to withstand a vertical load corresponding to more than five times a weight of the room cell.

18. The room cell according to claim 1, wherein the room cell has load-bearing properties and is able to withstand a vertical load corresponding to more than eight times of a weight of the room cell.

* * * * *